US012422201B2

(12) United States Patent
Terai et al.

(10) Patent No.: US 12,422,201 B2
(45) Date of Patent: Sep. 23, 2025

(54) HEAT EXCHANGER

(71) Applicant: DAIKIN INDUSTRIES, LTD., Osaka (JP)

(72) Inventors: Kou Terai, Osaka (JP); Yutaka Shibata, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 460 days.

(21) Appl. No.: 17/740,664

(22) Filed: May 10, 2022

(65) Prior Publication Data

US 2022/0268532 A1 Aug. 25, 2022

Related U.S. Application Data

(63) Continuation of application No. PCT/JP2020/043049, filed on Nov. 18, 2020.

(30) Foreign Application Priority Data

Nov. 25, 2019 (JP) ..... 2019-211987

(51) Int. Cl.
*F28F 9/02* (2006.01)
*F28D 9/00* (2006.01)
(Continued)

(52) U.S. Cl.
CPC ..... *F28F 9/028* (2013.01); *F28D 9/0037* (2013.01); *F28F 3/08* (2013.01); *F28F 3/12* (2013.01)

(58) Field of Classification Search
CPC ..... F28F 9/028; F28F 3/08; F28F 3/12; F28D 9/0037
(Continued)

(56) References Cited

U.S. PATENT DOCUMENTS 1,662,870 A * 3/1928 Stancliffe ..... F28D 9/0037 165/DIG. 392
6,293,338 B1 * 9/2001 Chapman ..... F28F 3/04 165/170
(Continued)

FOREIGN PATENT DOCUMENTS

CN 100453959 C 1/2009
EP 3399272 A1 11/2018
(Continued)

OTHER PUBLICATIONS

International Search Report issued in corresponding International Application No. PCT/JP2020/043049, mailed on Dec. 22, 2020 (6 pages).
(Continued)

*Primary Examiner* — Claire E Rojohn, III
(74) *Attorney, Agent, or Firm* — Osha Bergman Watanabe & Burton LLP

(57) ABSTRACT

A heat exchanger that heats or cools water with a fluid includes: a heat transfer portion that includes fluid flow paths through which a fluid flows, and water flow paths through which water flows and that are adjacent to the fluid flow paths; an upstream portion that forms an upstream space on an upstream side of the water flow paths; and a distributor disposed in the upstream space and that distributes water that flows into the upstream space from a water entering port to the water flow paths.

4 Claims, 7 Drawing Sheets

(51) Int. Cl.
*F28F 3/08* (2006.01)
*F28F 3/12* (2006.01)

(58) Field of Classification Search
USPC ..... 165/165
See application file for complete search history.

(56) References Cited

U.S. PATENT DOCUMENTS

| | | | | |
|---|---|---|---|---|
| 6,378,604 | B1 * | 4/2002 | Feind | F28D 9/0037 165/165 |
| 6,868,695 | B1 * | 3/2005 | Dingel | F28F 9/0278 62/515 |
| 7,147,050 | B2 * | 12/2006 | Kang | F28F 3/025 165/170 |
| 7,235,218 | B2 * | 6/2007 | Bowe | B01J 19/249 422/222 |
| 7,850,061 | B2 * | 12/2010 | Rigal | F28F 3/048 228/183 |
| 8,273,488 | B2 * | 9/2012 | Lee | H01M 8/04014 165/166 |
| 8,550,151 | B2 * | 10/2013 | Murayama | F28F 19/04 165/166 |
| 9,664,452 | B2 * | 5/2017 | Takada | F24F 3/147 |
| 10,168,101 | B2 * | 1/2019 | Zhang | F28F 3/02 |
| 10,175,007 | B2 * | 1/2019 | Wang | F28F 3/048 |
| 10,197,340 | B2 * | 2/2019 | Crayssac | F28D 9/0037 |
| 10,281,219 | B2 * | 5/2019 | Mizushita | F28F 3/08 |
| 10,612,823 | B2 * | 4/2020 | Moreaux | F28F 9/0214 |
| 10,845,132 | B2 * | 11/2020 | Ruiz | F28D 1/0366 |
| 11,060,802 | B2 * | 7/2021 | Lockwood | B23K 1/0012 |
| 11,306,979 | B2 * | 4/2022 | Yun | F28F 1/422 |
| 11,414,202 | B2 * | 8/2022 | Tomescu | H05K 7/20254 |
| 2003/0088982 | A1 * | 5/2003 | Ervin | B23P 19/10 29/464 |
| 2004/0112573 | A1 * | 6/2004 | Moeykens | F28D 3/02 165/118 |
| 2015/0136366 | A1 * | 5/2015 | Fukui | F28F 13/06 165/148 |
| 2015/0233618 | A1 * | 8/2015 | Sedlak | F25B 30/02 165/157 |
| 2015/0316326 | A1 * | 11/2015 | Choi | F28F 19/006 165/166 |
| 2015/0361922 | A1 * | 12/2015 | Alvarez | F28D 9/0081 165/185 |
| 2019/0376750 | A1 * | 12/2019 | Shibata | F28F 3/08 |
| 2020/0025427 | A1 * | 1/2020 | Higashiiue | F25B 39/028 |
| 2022/0268532 | A1 * | 8/2022 | Terai | F28F 3/048 |
| 2022/0333872 | A1 * | 10/2022 | Numata | F28D 9/0043 |
| 2022/0341637 | A1 * | 10/2022 | Numata | F28F 3/04 |
| 2022/0381487 | A1 * | 12/2022 | Shibata | F28F 9/22 |

FOREIGN PATENT DOCUMENTS

| | | | | | |
|---|---|---|---|---|---|
| JP | H11-37677 | A | | 2/1999 | |
| JP | 2001133194 | A | * | 5/2001 | B01J 19/002 |
| JP | 2007170271 | A | | 7/2007 | |
| JP | 2010-117102 | A | | 5/2010 | |
| KR | 20170029450 | A | | 3/2017 | |
| WO | 2014/010180 | A1 | | 1/2014 | |

OTHER PUBLICATIONS

Extended European search report issued in corresponding European Patent Application No. 20892247.6 dated Nov. 17, 2022 (6 pages).
International Preliminary Report on Patentability issued in corresponding International Application No. PCT/JP2020/043049, mailed on Jun. 9, 2022 (6 pages).

* cited by examiner

HEAT EXCHANGER

CROSS-REFERENCE TO RELATED APPLICATIONS

This is a continuation application of International Patent Application No. PCT/JP2020/043049, filed on Nov. 18, 2020, and claims priority to Japanese Patent Application No. 2019-211987, filed on Nov. 25, 2019. The content of these priority applications are incorporated herein by reference.

TECHNICAL FIELD

The present disclosure relates to a heat exchanger.

BACKGROUND

Hitherto, a heat exchanger that exchanges heat between water and a refrigerant has been used in, for example, a heat-pump air-conditioning and heating device or a heat-pump hot water supply device. As such a heat exchanger, a heat exchanger is described in, for example, Patent Literature 1 (Japanese Unexamined Patent Application Publication No. 2010-117102). Patent Literature 1 discloses a heat exchanger in which a layer having a plurality of water flow paths in which water flows and a layer having a plurality of refrigerant flow paths in which R410A flows are stacked upon each other.

SUMMARY

A heat exchanger according to one or more embodiments is a heat exchanger that heats or cools water with a fluid, and includes a heat transfer portion, an upstream portion, and a distribution portion. The heat transfer portion is such that a plurality of fluid flow paths in which a fluid flows and a plurality of water flow paths in which water flows are adjacent to each other. The upstream portion forms an upstream space on an upstream side of the plurality of water flow paths. The distribution portion is disposed in the upstream space and distributes to the plurality of water flow paths water that flows into the upstream space from a water entering port.

DETAILED DESCRIPTION

A heat exchanger according to one or more embodiments of the present disclosure is described below with reference to the drawings.

(1) Overall Structure

A heat exchanger 1 according to one or more embodiments of the present disclosure is a heat exchanger that heats or cools water with a fluid (here, a refrigerant). The heat exchanger 1 is used in a water circuit of, for example, an air conditioner or a hot water supply apparatus. The heat exchanger 1 of one or more embodiments is a water heat exchanger that can perform a cooling operation, a heating operation, and a defrosting operation.

Figure 1:
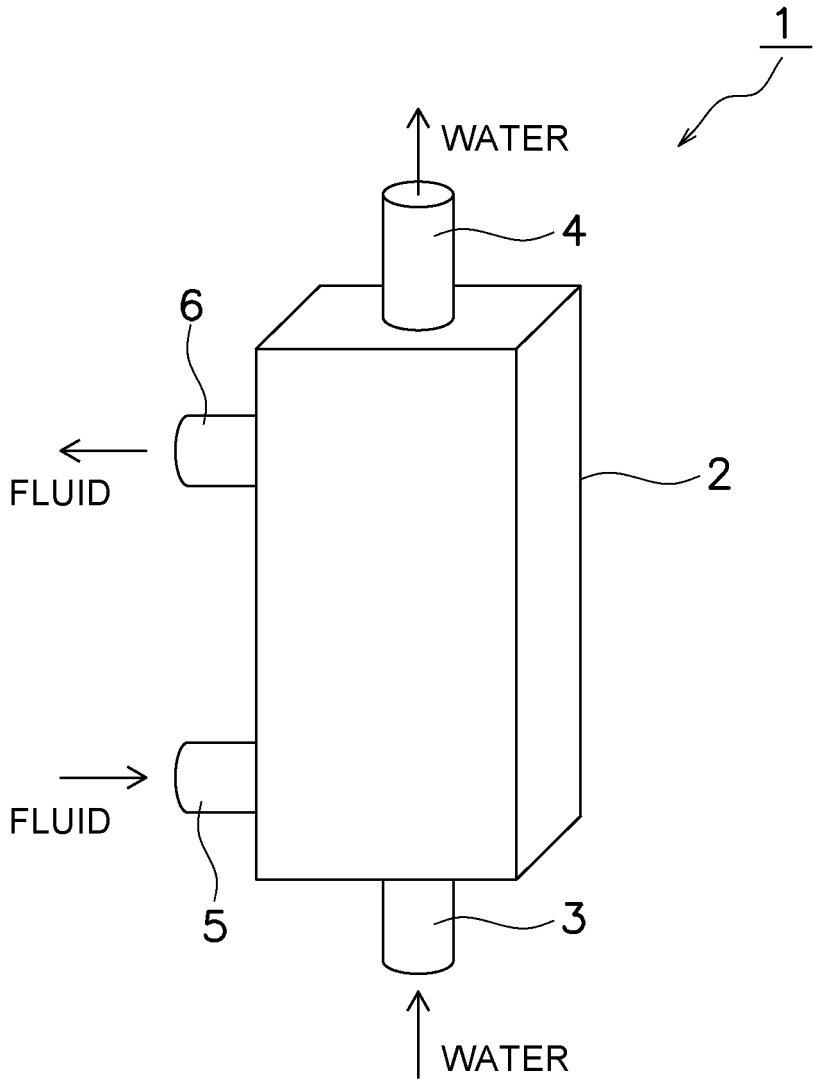
FIG. 1 is a perspective view showing a heat exchanger according to one or more embodiments.
Figure 2:
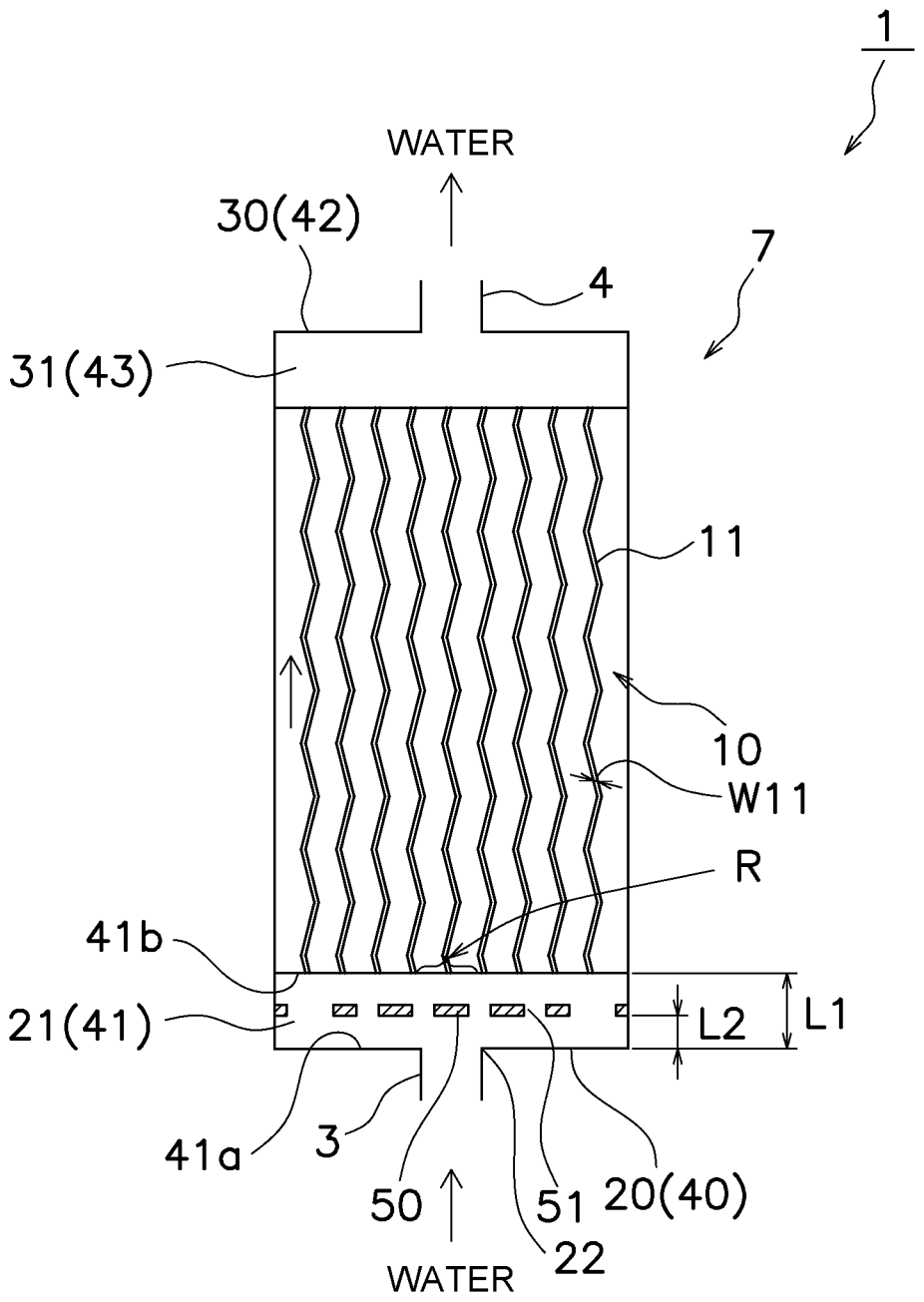
FIG. 2 is a plan view showing water flow paths of the heat exchanger according to one or more embodiments.
Figure 3:
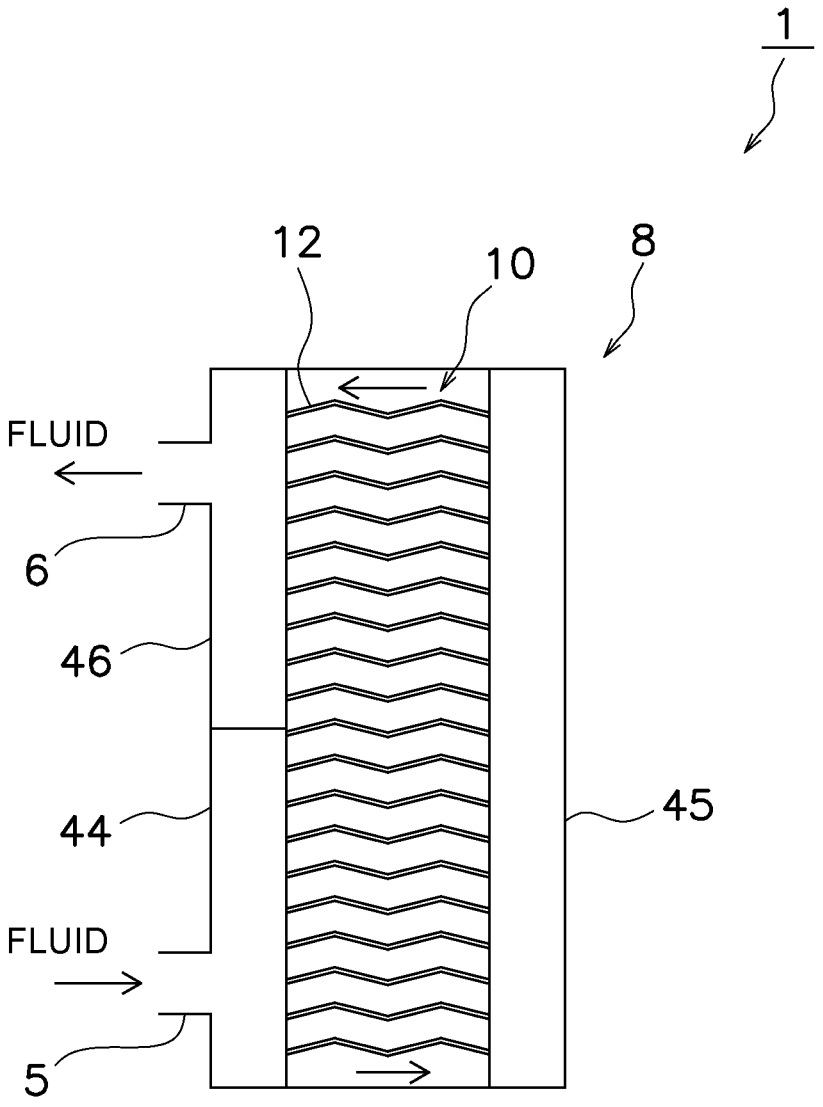
FIG. 3 is a plan view showing fluid flow paths of the heat exchanger according to one or more embodiments.

As shown in FIGS. 1 to 4, the heat exchanger 1 of one or more embodiments is a microchannel heat exchanger. The heat exchanger 1 includes a casing 2, a water inlet pipe 3, a water outlet pipe 4, a fluid inlet pipe 5, a fluid outlet pipe 6, which are shown in FIG. 1, first layers 7, one of which is shown in FIG. 2, and second layers 8, one of which is shown in FIG. 3.

The water inlet pipe 3, the water outlet pipe 4, the fluid inlet pipe 5, and the fluid outlet pipe 6 are attached to the casing 2. In detail, in FIG. 1, the water inlet pipe 3 is attached to the bottom, the water outlet pipe 4 is attached to the top, the fluid inlet pipe 5 is attached to a lower part of a side end portion, and the fluid outlet pipe 6 is attached to an upper part of the side end portion.

Figure 4:
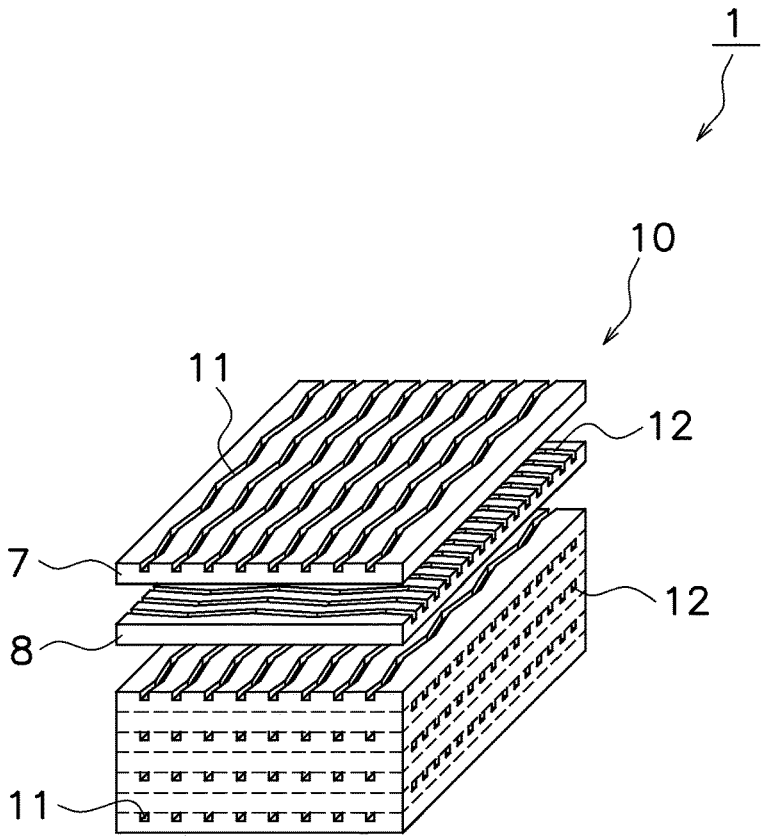
FIG. 4 is a perspective view schematically showing a state in which the water flow paths and the fluid flow paths of the heat exchanger according to one or more embodiments are stacked upon each other.

As shown in FIG. 4, the first layers 7 and the second layers 8 are alternately stacked upon each other. Note that FIG. 4 schematically shows a state in which the first layers 7 and the second layers 8 are stacked upon each other, and up-down directions, left-right directions, and the dimensions are not the same as those in the other figures. Water flow paths 11 in which water flows are formed in each first layer 7. Fluid flow paths 12 in which a fluid flows are formed in each second layer 8. The first layers 7 and the second layers 8 are each constituted by a metallic flat plate.

(2) Structure of Characteristic Portions

As shown in FIG. 2, the heat exchanger 1 includes a heat transfer portion 10, an upstream portion 20, a downstream portion 30, a header portion 40, and a distribution portion 50 (i.e., distributor). The heat transfer portion 10, the upstream portion 20, the downstream portion 30, the header portion 40, and the distribution portion 50 are accommodated in the casing 2.

The heat-transfer portion 10 is such that the water flow paths 11, shown in FIG. 2, in which water flows and the fluid flow paths 12, shown in FIG. 3, in which a fluid flows are adjacent to each other. The heat-transfer portion 10 has the plurality of water flow paths 11 and the plurality of fluid flow paths 12. Specifically, the plurality of water flow paths 11 and the plurality of fluid flow paths 12 are formed in a plurality of rows in the heat-transfer portion 10. In the heat transfer portion 10, a direction in which water flows and a direction in which a fluid flows intersect each other, and are here orthogonal to each other. Specifically, water flows from a lower side toward an upper side. A fluid flows from a lower left side toward a lower right side, passes through a header portion 45 described below, and flows from an upper right side toward an upper left side. Water that flows in the water flow paths 11 and a fluid that flows in the fluid flow paths 12 exchange heat with each other.

The water flow paths 11 and the fluid flow paths 12 have small diameters. A width W11 of each water flow path 11 shown in FIG. 2 is, for example, less than or equal to 1 mm. The width W11 is the minimum width of each water flow path 11. Although, as the width W11 is reduced, the performance is increased, from the viewpoint of suppressing closure, a lower limit is, for example, 0.3 mm.

Note that, although the water flow paths 11 and the fluid flow paths 12 have meandering shapes, the water flow paths 11 and the fluid flow paths 12 may have linearly extending shapes.

The upstream portion 20 is positioned on an upstream side of each water flow path 11. Here, the upstream portion 20 is positioned below the water flow paths 11. The upstream portion 20 forms an upstream space 21 on the upstream side of each water flow path 11.

The upstream portion 20 includes a water entering port 22 that communicates with the water inlet pipe 3. Water flows into the upstream space 21 from the water entering port 22. The water entering port 22 opposes at least a part of the plurality of water flow paths 11. Here, the water entering port 22 opposes the plurality of water flow paths 11 at a central portion.

The downstream portion 30 is positioned on a downstream side of each water flow path 11. Here, the downstream portion 30 is positioned above the water flow paths 11. The downstream portion 30 forms a downstream space 31 on the downstream side of each water flow path 11. The downstream space 31 communicates with the water outlet pipe 4.

The heat exchanger 1 of one or more embodiments further includes the header portion 40. The header portion 40 forms a header space 41 for causing water that has flowed in from the water entering port 22 to be divided and to flow to the plurality of water flow paths 11. The header portion 40 that forms the header space 41 for causing water to be divided and to flow to the water flow paths 11 includes the upstream portion 20 that forms the upstream space 21.

Each first layer 7 further includes a header portion 42 that forms a header space 43 for gathering water that has flowed out of the plurality of water flow paths 11. The header portion 42 that forms the header space 43 for gathering the water that has flowed out of the water flow paths 11 includes the downstream portion 30 that forms the downstream space 31.

The water inlet pipe 3 and the water outlet pipe 4 communicate with the water flow paths 11 via the header portions 40 and 42.

Note that the second layer 8 shown in FIG. 3 further includes header portions 44 to 46. The header portion 44 forms a header space for causing flow division with respect to the plurality of fluid flow paths 12. The header portion 45 forms a header space for gathering water that has flowed out of a plurality of lower fluid flow paths 12 and for causing the water to be divided and to flow to a plurality of upper fluid flow paths 12. The header portion 46 forms a header space for gathering water that has flowed out of the plurality of upper fluid flow paths 12. The fluid inlet pipe 5 and the fluid outlet pipe 6 communicate with the fluid flow paths 12 via the header portions 44 to 46.

As shown in FIG. 2, the distribution portion 50 distributes to the plurality of water flow paths 11 water that flows into the upstream space 21 from the water entering port 22. The distribution portion 50 has a mechanism for uniformly distributing water to the plurality of water flow paths 11.

The distribution portion 50 is disposed in the upstream space 21. Here, the distribution portion 50 is disposed in the header space 41.

Specifically, the distribution portion 50 is disposed between the plurality of water flow paths 11 and the water entering port 22. In detail, the distribution portion 50 is disposed between the water entering port 22 and an opposing region R, opposing the water entering port 22, in the plurality of water flow paths 11. The distribution portion 50 in FIG. 2 is disposed between the plurality of water flow paths 11 in their entirety (the opposing region R and a non-opposing region) and the water entering port 22.

Figure 5:
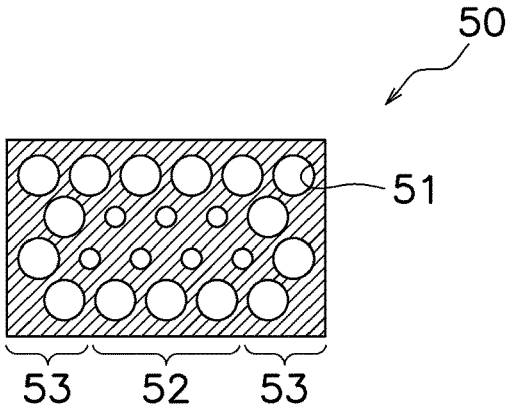
FIG. 5 is a plan view showing a distribution portion of the heat exchanger according to one or more embodiments.

As shown in FIGS. 2 and 5, the distribution portion 50 is a plate member. In detail, the distribution portion 50 is a plate member having a surface that intersects a direction of flow of water. Here, the distribution portion 50 is a plate member having a surface that is orthogonal to the direction of flow of water.

The distribution portion 50 has one or more through holes 51. The plurality of through holes 51 of the distribution portion 50 shown in FIG. 5 have circular shapes. In FIG. 5, the through holes 51 that are positioned at an outer peripheral portion are larger than the through holes 51 that are positioned at a central portion.

The distribution portion 50 has an opposing portion 52 that opposes the water entering port 22 and a non-opposing portion 53 that does not oppose the water entering port 22. The through holes 51 that are positioned at the opposing portion 52 are smaller than the through holes 51 that are positioned at the non-opposing portion 53.

As shown in FIG. 2, in the header space 41, a ratio (L2/L1) of a distance L2 between a first surface 41*a*, where the water entering port 22 is formed, and the distribution portion 50 to a distance L1 between the first surface 41*a* and a second surface 41*b*, where inlets of the plurality of water flow paths 11 are formed, is greater than 0 and less than 1, may be greater than or equal to 0.2 and less than or equal to 0.8, and may be greater than or equal to ⅓ and less than or equal to ⅔.

The distribution portion 50 is made of, for example, a metal. Although the material of which the distribution portion 50 is made may differ from the material of which each first layer 7 is made, here, the materials are the same. The distribution portion 50 is made of, for example, stainless steel, copper, or aluminum.

The distribution portion 50 of one or more embodiments may be formed separately from a member that constitutes the upstream portion 20. The distribution portion 50 is, for example, attached to the upstream space 21 by welding or the like. In detail, with a predetermined number of first layers 7 and second layers 8 being stacked upon each other, for example, after joining them by diffusion bonding or the like, for example, the distribution portion 50 is disposed in the upstream space 21 by welding or the like.

The heat exchanger 1 having such a structure is used as, for example, an evaporator. Specifically, water is introduced into the upstream portion 20 from the water inlet pipe 3. Water that has been introduced into the upstream space 21 is distributed to the plurality of water flow paths 11 by the distribution portion 50 disposed in the upstream space 21 (here, the header space 41).

In the plurality of water flow paths 11, a pressure loss of the water flow paths 11 (the opposing region R) that oppose the water entering port 22 is smaller than a pressure loss of the water flow paths 11 that do not oppose the water entering port 22. In the distribution portion 50 of one or more embodiments, the through holes 51 that are positioned at the opposing portion 52 are smaller than the through holes 51 that are positioned at the non-opposing portion 53. Therefore, the amount of water that is supplied to the non-opposing region in the water flow paths 11 is larger than the amount of water that is supplied to the opposing region R in the water flow paths 11. Consequently, water that has passed through the through holes 51 of the distribution portion 50 is suppressed from drifting, and flows into the water flow paths.

On the other hand, a fluid that has been introduced from the fluid inlet pipe 5 flows into the fluid flow paths 12. In the heat transfer portion 10, water that flows in the water flow paths 11 and a fluid that flows in the fluid flow paths 12 exchange heat with each other. Water that has flowed out of the water flow paths 11 is discharged from the water outlet pipe 4 via the downstream space 31.

In the second layer 8, a fluid that has been introduced from the fluid inlet pipe 5 flows into the lower fluid flow paths 12 in FIG. 3 via the header portion 44. Thereafter, the fluid passes through the lower fluid flow paths 12 in FIG. 3 and passes through the upper fluid flow paths 12 in FIG. 3 via the header portion 45. The fluid that has exchanged heat flows out of the fluid flow paths 12 and is discharged from the fluid outlet pipe 6 via the header portion 46.

In the heat exchanger 1 of one or more embodiments, the distribution portion 50 is disposed in the upstream space 21 disposed upstream of the plurality of water flow paths 11. Before water flows into the water flow paths 11, the distribution portion 50 can distribute to the plurality of water flow paths water that flows into the upstream space 21. Therefore, the water can flow uniformly and can be suppressed from drifting to the plurality of water flow paths 11. Consequently, since, in the plurality of water flow paths, the number of portions where the amount of water that flows is relatively small can be reduced, water that flows in the water flow paths 11 can be suppressed from freezing.

In the heat exchanger 1 having water flow paths in which water flows from the lower side toward the upper side as in the embodiments described above, freezing at a downstream region of the water flow paths 11 that are positioned at end portions can be effectively suppressed. The heat exchanger 1 of one or more embodiments is particularly effective when the heat exchanger 1 is used as an evaporator in which a refrigerant temperature may become very low and when a defrosting operation is performed.

Accordingly, since the heat exchanger 1 can suppress drifting by the distribution portion 50, the heat exchanger 1 can suppress the water flow paths 11 from being closed due to freezing. Since resistance to freezing can be increased, damage to the heat exchanger 1 can be reduced. Therefore, the heat exchanger 1 of one or more embodiments can allow a reduction in the diameter of the water flow paths 11.

(3) Features

A heat exchanger according to one or more embodiments is a heat exchanger that heats or cools water with a fluid, and includes a heat transfer portion, an upstream portion, and a distribution portion. The heat transfer portion is such that a plurality of fluid flow paths in which a fluid flows and a plurality of water flow paths in which water flows are adjacent to each other. The upstream portion forms an upstream space on an upstream side of the plurality of water flow paths. The distribution portion is disposed in the upstream space and distributes to the plurality of water flow paths water that flows into the upstream space from a water entering port.

The freezing of water that flows in the water flow paths may be caused by water not flowing uniformly and drifting to the plurality of water flow paths. When the water drifts, in the plurality of water flow paths, a portion thereof where the amount of water that flows is relatively small tends to freeze.

Therefore, in the heat exchanger according to one or more embodiments, water that flows into the upstream space disposed upstream of the plurality of water flow paths can be distributed to the plurality of water flow paths due to the distribution portion being disposed in the upstream space. Therefore, the water can be suppressed from drifting to the plurality of water flow paths. Consequently, the water that flows in the water flow paths can be suppressed from freezing.

In a heat exchanger according to one or more embodiments, the distribution portion is a plate member.

In the heat exchanger according to one or more embodiments, water that flows into the upstream space from the water entering port can be easily distributed to the plurality of water flow paths. Therefore, since the water can be easily suppressed from drifting to the plurality of water flow paths, it is possible to realize a heat exchanger that can suppress the water that flows in the water flow paths from freezing.

In a heat exchanger according to one or more embodiments, at least a part of the plurality of water flow paths have an opposing region that opposes the water entering port. The plate member is disposed between the opposing region and the water entering port.

In the heat exchanger according to one or more embodiments, the plate member is disposed between the water flow paths opposing the water entering port and the water entering port. Therefore, water that flows into the upstream space from the water entering port can be easily distributed to the plurality of water flow paths so as to suppress drifting.

In a heat exchanger according to one or more embodiments, the plate member has a through hole.

In the heat exchanger according to one or more embodiments, water that flows into the upstream space from the water entering port can be more easily distributed to the plurality of water flow paths so as to suppress drifting by causing the water to pass through the through hole of the plate member.

In a heat exchanger according to one or more embodiments, the plate member is disposed between the plurality of water flow paths and the water entering port. The plate member has an opposing portion that opposes the water entering port and a non-opposing portion that does not oppose the water entering port. The through hole that is positioned at the opposing portion is smaller than the through hole that is positioned at the non-opposing portion.

In the heat exchanger according to one or more embodiments, in the plurality of water flow paths, a pressure loss of the water flow paths that oppose the water entering port is smaller than a pressure loss of the water flow paths that do not oppose the water entering port. In the plate member, since the through hole that is positioned at the opposing portion is smaller than the through hole that is positioned at the non-opposing portion, water that flows into the upstream space from the water entering port can be distributed in a larger amount to the water flow paths that do not oppose the water entering port (that oppose the non-opposing portion) than to the water flow paths that oppose the water entering port (the opposing portion). Therefore, the water that flows into the upstream space from the water entering port can be distributed in a relatively small amount to the water flow paths having a small pressure loss and can be distributed in a relatively large amount to the water flow paths having a large pressure loss. Consequently, since a drift can be further suppressed, water that flows in the water flow paths can be further suppressed from freezing.

A heat exchanger according to one or more embodiments further includes a header portion that forms a header space for causing water that has flowed in from the water entering port to be divided and to flow to the plurality of water flow paths. The distribution portion is disposed in the header space.

In the heat exchanger according to one or more embodiments, the distribution portion is disposed in the header space, which is a relatively large upstream space. Therefore, the freedom with which the distribution portion is disposed can be increased.

In a heat exchanger according to one or more embodiments, the distribution portion is a plate member. At least a part of the plurality of water flow paths oppose the water entering port. The plate member is disposed between the plurality of water flow paths and the water entering port. In the header space, a ratio of a distance between a first surface, where the water entering port is formed, and the plate member to a distance between the first surface and a second surface, where inlets of the plurality of water flow paths are formed, is greater than or equal to 0.2 and less than or equal to 0.8.

In the heat exchanger according to one or more embodiments, a space can be provided between an upstream side and a downstream side of the plate member disposed in the header space. Therefore, water that flows into the upstream space from the water entering port can be easily distributed to the plurality of water flow paths so as to suppress drifting.

In a heat exchanger according to one or more embodiments, a width of each of the plurality of water flow paths is less than or equal to 1 mm.

In the heat exchanger according to one or more embodiments, if the width of the plurality of water flow paths is reduced to a diameter of 1 mm or less, the heat exchanger of the present disclosure can suppress water from drifting to the plurality of water flow paths. Consequently, performance can be increased and the water that flows in the water flow paths can be suppressed from freezing.

(4) Modifications (4-1) Modification 1

Although, in the embodiments described above, a microchannel heat exchanger that can perform a cooling operation, a heating operation, and a defrosting operation is given as an example and described, the heat exchanger is not limited thereto. The heat exchanger of the present disclosure can be used in general for heat exchangers that use water as a medium that exchanges heat. In the present modification, the heat exchanger is used for a chiller.

(4-2) Modification 2

Figure 6:
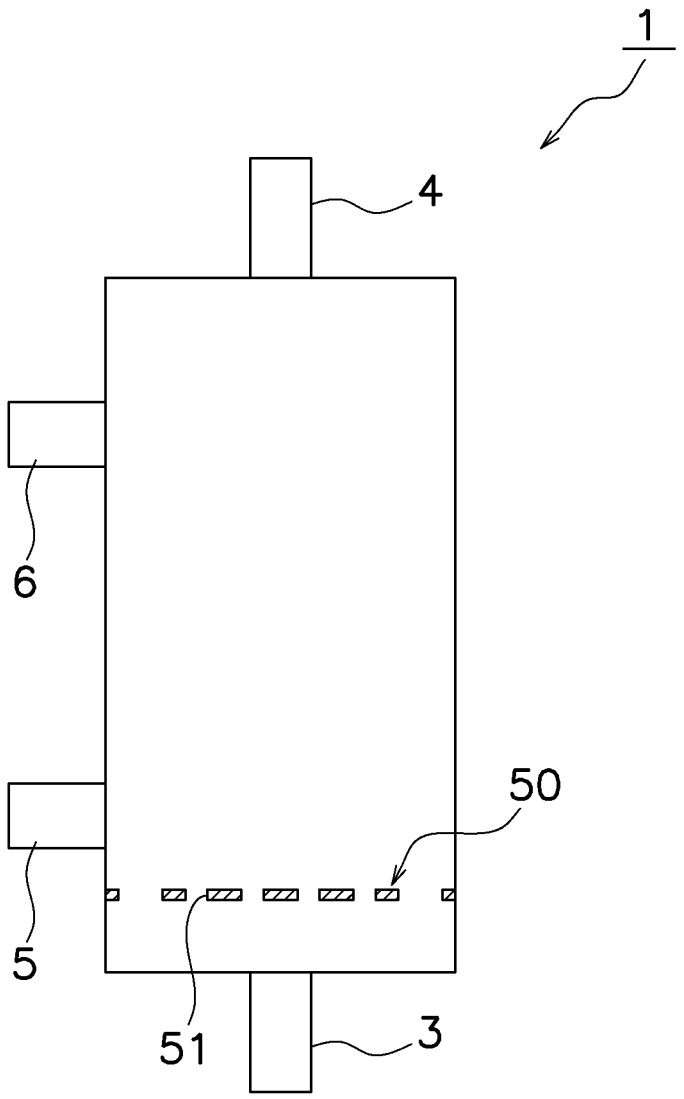
FIG. 6 is a schematic view showing the heat exchanger according to one or more embodiments.
Figure 7:
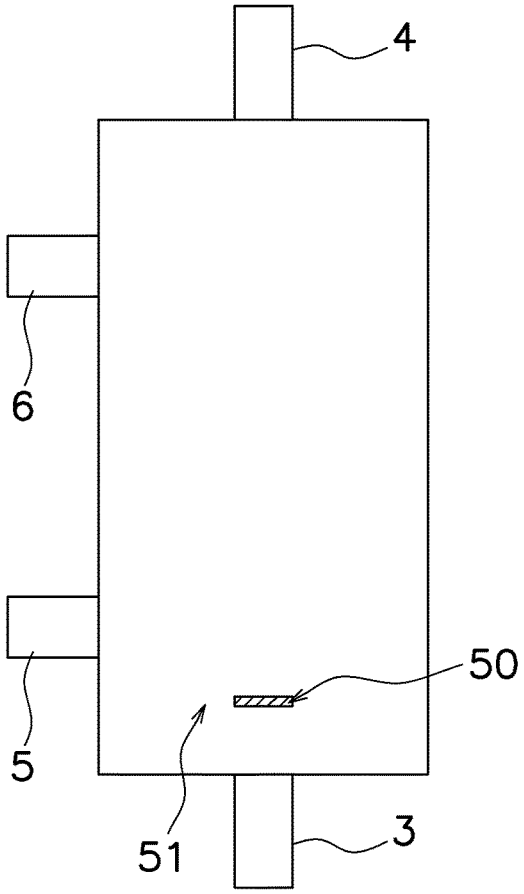
FIG. 7 is a schematic view showing a heat exchanger according to a modification.
Figure 8:
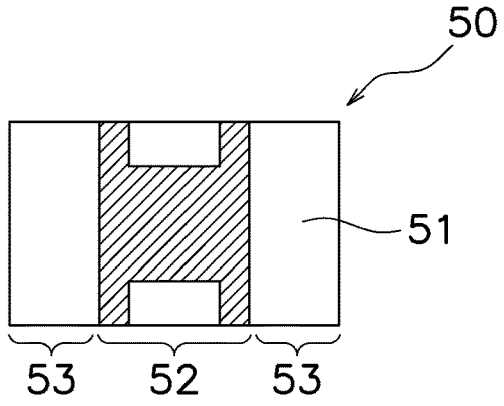
FIG. 8 is a plan view showing a distribution portion of the heat exchanger according to the modification.

Although, in the embodiments described above, as shown in FIG. 6, the distribution portion 50 having dispersed through holes 51 is given as an example and described, the distribution portion 50 is not limited thereto. Note that FIGS. 6 and 7 are each a schematic view showing a disposition of the distribution portion 50 inside the heat exchanger 1. In the present modification, as shown in FIGS. 7 and 8, in the distribution portion 50, there may be no through holes 51 at the opposing portion 52 and there may be through holes 51 only at the non-opposing portion 53.

The shape of the through holes 51 is not limited, and is selected as appropriate in accordance with, for example, the position of the water entering port or the shape of the water flow paths. The through holes 51 of the present modification each have a rectangular shape.

(4-3) Modification 3

Figure 9:
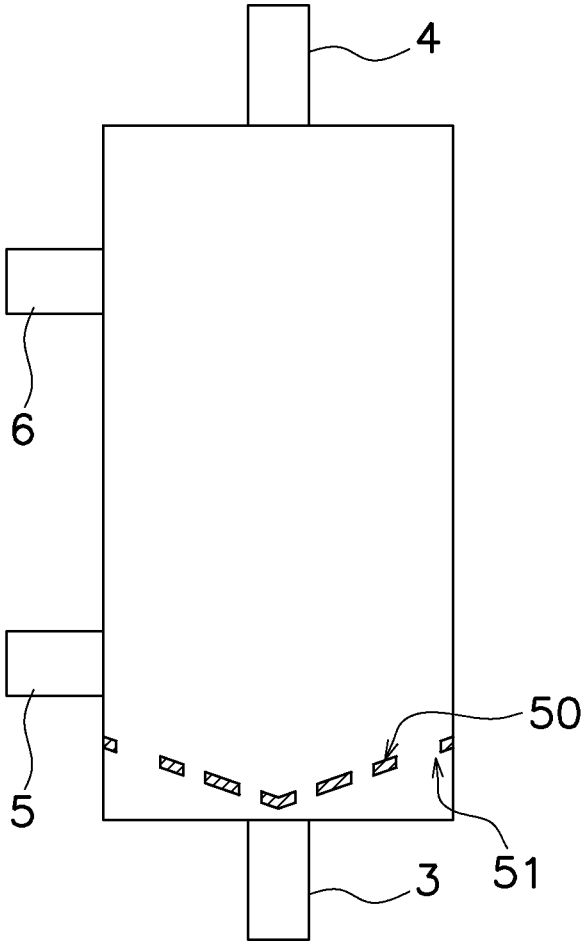
FIG. 9 is a schematic view showing a heat exchanger according to a modification.

Although, in the embodiments described above, the distribution portion 50 has a surface that is orthogonal to the direction of flow of water, the distribution portion 50 may have a surface that intersects the direction of flow of water. The intersecting surface may be a flat surface or a curved surface. In the present modification, as shown in FIG. 9, the distribution portion 50 is a plate member having a surface that is inclined with respect to the direction of flow of water. In detail, the distribution portion 50 is a V-shaped plate member that is inclined upward from the center toward end portions.

(4-4) Modification 4

Although, in the embodiments described above, the distribution portion 50 is one plate member, the distribution portion 50 may be a plurality of plate members. The plurality of plate members may be disposed so as to extend parallel to each other, or may be disposed so as not to extend parallel to each other.

(4-5) Modification 5

Although, in the embodiments described above, the distribution portion 50 is a plate member, the distribution portion 50 is not limited thereto. The distribution portion 50 of the present modification includes a plurality of protrusions that protrude from a member that partitions the upstream space 21 toward the upstream space 21. The protrusions each have a through hole. In this case, the member that partitions the upstream space 21 and the protrusions may be integrated with each other.

(4-6) Modification 6

Although, in the embodiments described above, a refrigerant is taken as an example of a fluid that exchanges heat with water and is described, the fluid is not limited thereto. The fluid of the present modification is a heat medium such as $CO_2$.

<Supplementary Note>

Although the disclosure has been described with respect to only a limited number of embodiments, those skilled in the art, having benefit of this disclosure, will appreciate that various other embodiments may be devised without departing from the scope of the present disclosure. Accordingly, the scope of the disclosure should be limited only by the attached claims.

REFERENCE SIGNS LIST

1 heat exchanger
2 casing
3 water inlet pipe
4 water outlet pipe
5 fluid inlet pipe
6 fluid outlet pipe
7 first layer
8 second layer
10 heat transfer portion
11 water flow path
12 fluid flow path
20 upstream portion
21 upstream space
22 water entering port
40 header portion
41 header space
41*a* first surface
41*b* second surface
50 distribution portion
51 through hole
52 opposing portion
53 non-opposing portion
R opposing region

PATENT LITERATURE

PTL 1: Japanese Unexamined Patent Application Publication No. 2010-117102

What is claimed is:

1. A heat exchanger that heats or cools water with a fluid, the heat exchanger comprising:

a heat transfer portion that comprises:

fluid flow paths through which a fluid flows; and water flow paths through which water flows and that are adjacent to the fluid flow paths;

an upstream portion that forms an upstream space on an upstream side of the water flow paths; and a distributor plate disposed in the upstream space between the water flow paths and a water entering port and that distributes water that flows into the upstream space from the water entering port to the water flow paths, wherein the distributor plate comprises:

an opposing portion that opposes the water entering port; and a non-opposing portion that does not oppose the water entering port, both of the opposing portion and the non-opposing portion are disposed in the upstream space, the distributor plate has:

a first through hole in the opposing portion; and a second through hole in the non-opposing portion, and the first through hole is smaller than the second through hole.

2. The heat exchanger according to claim 1, further comprising:

a header portion that forms a header space and that causes water that has flowed in from the water entering port to be divided and to flow to the water flow paths, wherein the distributor plate is disposed in the header space.

3. The heat exchanger according to claim 2, wherein some of the water flow paths oppose the water entering port, in the header space, the water entering port is disposed on a first surface, inlets of the water flow paths are disposed on a second surface, and a ratio of a distance from the first surface to the distributor plate to a distance from the first surface to the second surface is greater than or equal to 0.2 and less than or equal to 0.8.

4. The heat exchanger according to claim 1, wherein a width of each of the water flow paths is less than or equal to 1 mm.

* * * * *